United States Patent [19]

Nagamoto et al.

[11] Patent Number: 4,636,819

[45] Date of Patent: Jan. 13, 1987

[54] THERMOSENSITIVE RECORDING MATERIAL

[75] Inventors: Masanaka Nagamoto, Shizuoka; Norio Kurisu, Numazu; Keishi Taniguchi, Shizuoka, all of Japan

[73] Assignee: Ricoh Company, Ltd., Tokyo, Japan

[21] Appl. No.: 823,001

[22] Filed: Jan. 27, 1986

[30] Foreign Application Priority Data

Feb. 1, 1985 [JP] Japan ..... 60-018010

[51] Int. Cl.[4] ..... B41M 5/18

[52] U.S. Cl. ..... 346/216; 346/200; 346/217; 346/221; 346/225; 346/226; 427/151; 427/152

[58] Field of Search ..... 346/200, 216, 217, 221, 346/225, 226; 427/150–152

[56] References Cited

U.S. PATENT DOCUMENTS 4,379,721 4/1983 Qualitz et al. ..... 346/216
4,482,378 11/1984 Riou et al. ..... 346/216
4,536,219 8/1985 Riou et al. ..... 346/216

*Primary Examiner*—Bruce H. Hess
*Attorney, Agent, or Firm*—Oblon, Fisher, Spivak, McClelland, & Maier

[57] ABSTRACT

A thermosensitive recording material comprises (a) a support member, (b) a thermosensitive coloring layer formed on the support member, comprising a colorless or light-colored leuco dye, a zinc thiocyanate antipyrine complex having the following formula, which serves as a color developer capable of inducing color formation in the leuco dye upon application of heat thereto, and (c) a protective layer formed on the thermosensitive coloring layer, consisting essentially of a water-soluble resin for protecting the thermosensitive coloring layer.

14 Claims, No Drawings

THERMOSENSITIVE RECORDING MATERIAL

BACKGROUND OF THE INVENTION

The present invention relates to a thermosensitive recording material which is improved, in particular with respect to the stability of recorded images. The thermosensitive recording material comprises (a) a support member, (b) a thermosensitive coloring layer formed on the support member, comprising a leuco dye which is a colorless or light-colored at room temperature, and an antipyrine complex of zinc thiocyanate (hereinafter referred to as the zinc thiocyanate antipyrine complex) which serves as a color developer capable of inducing color formation in the leuco dye upon application of heat thereto, and (c) a protective layer formed on the thermosensitive coloring layer, consisting essentially of a water-soluble resin for protecting the thermosensitive coloring layer.

A conventional thermosensitive recording material comprises a support member such as a sheet of paper and a thermosensitive coloring layer formed on the support material, on which thermosensitive coloring layer colored images can be formed by application of heat thereto, for example, through thermal head, thermal pen, laser beams or strobo lamp.

Such thermosensitive recording materials are employed in a variety of fields, for instance, for use with printers of computers, recorders of medical analytical instruments, facsimile apparatus, automatic ticket vending apparatus, and thermosensitive copying apparatus, since they have the following advantages over other conventional recording materials. (1) Images can be formed by simple heat application, without complicated steps for development and image fixing, and therefore image recording can be speedily performed by a simple recording apparatus, without generation of noise and causing environmental pollution; and (2) the thermosensitive recording materials are inexpensive.

In such conventional thermosensitive recording materials, there is usually employed in the thermosensitive coloring layer a thermal coloring system comprising a combination of (i) a colorless or light-colored leuco dye containing a lactone ring, a lactam ring or a spiropyran ring, and (ii) a color developer which induces color formation in the leuco dye upon application of heat by the reaction with the leuco dye. As such color developers, for example, organic acids and phenolic materials are employed. Thermal coloring systems comprising a combination of such leuco dye and color developer are widely used, since the color tone of the images produced by such coloring systems is clear, the background of thermosensitive recording materials employing this coloring system is high in the degree of whiteness, and the produced images are highly resistant to light, so that the images do not easily fade.

As color developers for use with conventional leuco dyes, Bisphenol A and p-hydroxybenzoic acid esters are usually used. These phenolic compounds, however, have the shortcomings that produced images are so unstable that the image density gradually decreases with time even if the images are allowed to stand under normal office conditions, and in particular, when the images come into contact, for instance, with oils from hands, the image density is significantly decreased. Organic acids also have such shortcoming when they are used as color developers. Therefore, there is a strong demand for improvement of the stability of images developed in thermosensitive recording materials.

In the field of pressure sensitive recording sheet, metal compounds of aromatic carboxylic acids are proposed as being color developers capable of yielding stable images, as disclosed in Japanese Patent Publication No. 52-1327. When such metal compounds of aromatic carboxylic acids are applied for a conventional thermosensitive recording material, images are in fact stabilized. However, the non-image areas (background) of the thermosensitive recording material are easily discolored when coming into contact with oils, so that the developed images become illegible. Therefore, such metal compounds of aromatic carboxylic acids are not suitable for use in the thermosensitive recording materials.

In addition, as color developers, metal salts of aromatic carboxylic acids, such as metal salts of salicylic acid and 2-hydroxy-3-naphthoic acid, are also proposed as color developers. These color developers, when employed in thermosensitive recording materials, also have the shortcoming that developed images are significantly discolored when coming into contact with oils.

In order to eliminate the above conventional problems, the inventors of the present invention have proposed a thermosensitive recording material which is improved with respect to the stability of developed images by use of an antipyrine complex of zinc thiocyanate as the color developer for leuco dyes. This thermosensitive recording material is in fact improved with the stability of the developed images and background when coming into contact with oils, plasticizers and alcohols, as compared with conventional thermosensitive recording materials using Bisphenol A as the color developer for leuco dyes. However, it has the shortcomings that the image density of developed images is decreased when the images are brought into contact with a wrapping film made of polyvinyl chloride under application of pressure thereto at high humidities and that the background is colored or discolored when coming into contact with alcohols when the antipyrine complex is used in combination with particular leuco dyes.

SUMMARY OF THE INVENTION

It is therefore an object of the present invention to provide an improved thermosensitive recording material which is substantially free from the conventional problems of the discoloration of developed images and background and the fading of developed colored images, even if the images come into contact with, for instance, oils, plasticizers contained in plastic wrapping films, alcohols and other chemicals.

Another object of the present invention is to provide a thermosensitive recording material which is capable of yielding images with high density and high sharpness with high thermal response, which images are stable under application of pressure at high humidities.

The above objects of the present invention can be attained by a thermosensitive recording material which comprises (a) a support member, (b) a thermosensitive coloring layer formed on the support member, comprising a leuco dye which is a colorless or light-colored at room temperature, a zinc thiocyanate antipyrine complex having the following formula, which serves as a color developer capable of inducing color formation in the leuco dye upon application of heat thereto, and (c) a protective layer consisting essentially of a water-soluble resin for protecting the thermosensitive coloring layer:

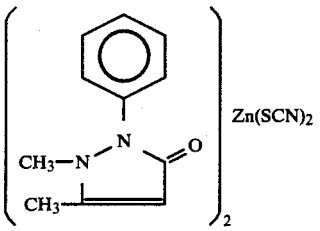

When necessary, an undercoat layer can be interposed between the support member and the thermosensitive coloring layer.

DETAILED DESCRIPTION OF THE PREFERRED EMBODIMENTS

In the present invention, as the water-soluble resin for use in the protective layer for the thermosensitive coloring layer, conventional water-soluble polymeric materials and aqueous emulsions of water-soluble polymeric materials can be employed.

Specific examples of such water-soluble polymeric materials are polyvinyl alcohol, starch, starch derivatives, cellulose derivatives such as methoxycellulose, hydroxyethylcellulose, carboxymethylcellulose, methylcellulose and ethylcellulose, sodium polyacrylate, polyvinyl pyrrolidone, polyacrylamide/acrylic acid ester copolymer, acrylamide/acrylic acid ester/methacrylic acid copolymer, styrene/maleic anhydride copolymer alkali salt, isobutylene/maleic anhydride copolymer alkali salt, polyacrylamide, sodium alginate, gelatin, casein, water-soluble polyester and carboxyl-group-modified polyvinyl alcohol.

When necessary, in the protective layer, the following water-insoluble resins can be employed in combination with the above mentioned water-soluble polymeric resins: polyvinyl acetate, polyurethane, styrene/butadiene copolymer, polyacrylic acid, polyacrylic acid ester, vinyl chloride/vinyl acetate copolymer, polybutylmethacrylate, ethylene/vinyl acetate copolymer and styrene/butadiene/acrylic derivative copolymer.

When such a water-insoluble resin is employed in combination with the above-mentioned water-soluble resin, it is preferable that the amount of the water-soluble resin be 20 wt. % or more, more preferably 30 wt. % or more, with respect to the entire weight of the resins contained in the protective layer (a water-resisting agent, if any in the protective layer, is not counted for this calculation).

In the above protective layer, there can be added a water-resisting agent such as polyamide resin, melamine resin, formaldehyde, glyoxal and chromium alum. By use of such water-resisting agent in the protective layer, the water-resisting property of the protective layer can be significantly improved. It is preferable that the amount of the water-resisting agent be in the range of 0.1 to 2.0 parts by weight, more preferably in the range of 0.2 to 1.0 part by weight, to one part by weight of the water-soluble resin contained in the protective layer.

In order to improve the thermal head matching properties of the thermosensitive recording material, the following fillers can be contained in the protective layer: finely-divided inorganic powders of calcium carbonate, silica, zinc oxide, titanium oxide, aluminum hydroxide, zinc hydroxide, barium sulfate, clay, talc, surface-treated calcium and surface-treated silica, and finely-divided organic powders of urea - formaldehyde resin, styrene/methacrylic acid copolymer and polystyrene.

In order to increase the thermal sensitivity and thermal head matching properties of the recording material, there can be interposed an undercoat layer between the support member and the thermosensitive coloring layer. Such undercoat layer comprises as the main components a binder resin and a filler having relatively high oil absorbability. When necessary, compounds capable of inducing color formation in a leuco dye or promoting such color formation, for instance, phenolic compounds and other organic acids, can also be contained in the undercoat layer.

Specific examples of binder resins for use in the undercoat layer are polyvinyl alcohol, starch, starch derivatives, cellulose derivatives such as methoxycellulose, hydroxyethylcellulose, carboxymethylcellulose, methylcellulose and ethylcellulose, sodium polyacrylate, polyvinyl pyrrolidone, polyacrylamide/acrylic acid ester copolymer, acrylamide/acrylic acid ester/methacrylic acid copolymer, styrene/maleic anhydride copolymer alkali salt, isobutylene/maleic anhydride copolymer alkali salt, polyacrylamide, sodium alginate, gelatin, casein, water-soluble polymers such as carboxyl-group-modified polyvinyl alcohol and water-soluble polyester, polyvinyl acetate, polyurethane, styrene/butadiene copolymer, polyacrylic acid, polyacrylic acid ester, vinyl chloride/vinyl acetate copolymer, polybutylmethacrylate, ethylene/vinylacetate copolymer and styrene/butadiene acrylic derivative copolymer.

Specific examples of fillers for use in the undercoat layer are finely-divided inorganic powders of calcium carbonate, silica, zinc oxide, titanium oxide, aluminum hydroxide, zinc hydroxide, barium sulfate, clay, talc, surface-treated calcium and surface-treated silica, and finely-divided organic powders of urea - formaldehyde resin, styrene/methacrylic acid copolymer and polystyrene.

Water-resisting agents can also be contained in the undercoat layer as in the case of the protective layer.

As the leuco dyes for use in the present invention, any conventional leuco dyes for use in conventional thermosensitive recording materials can be employed. For example, example, triphenylmethane-type leuco compounds, fluoran-type leuco compounds, phenothiazine-type leuco compounds, auramine-type leuco compounds and spiropyran-type leuco compounds are preferably employed.

Specific examples of those leuco dyes are as follows:

3,3-bis(p-dimethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)-phthalide,
3- cyclohexylamino-6-chlorofluoran,
3-dimethylamino-5,7-dimethylfluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran, 2-[N-(3'-trifluoromethylphenyl)amino]-6-diethylamino-fluoran,
2-[3,6-bis(diethylamino)-9-(o-chloroanilino)xanthylbenzoic acid lactam],
3-diethylamino-6-methyl-7-(m-trichloromethylanilino)-fluoran,
3-diethylamino-7-(o-chloroanilino)fluoran,
3-dibutylamino-7-(o-chloroanilino)fluoran,
3-N-methyl-N-amylamino-6-methyl-7-anilinofluoran,
3-N-methyl-N-cyclohexylamino-6-methyl-7-anilino-fluoran,
3-diethylamino-6-methyl-7-anilinofluoran,
3-(N,N-diethylamino)-5-methyl-7-(N,N-dibenzylamino) fluoran,
benzoyl leuco methylene blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(4'-hydroxy-4'-diethylaminophenyl)-3-(2'-methoxy-5'-methylphenyl)phthalide,
3-(2'-methoxy-4'-dimethylaminophenyl)-3-(2'-hydroxy-4'-chloro-5'-methylphenyl)phthalide,
3-morpholino-7-(N-propyl-trifluoromethylanilino)-fluoran,
3-pyrrolidino-7-trifluoromethylanilinofluoran,
3-diethylamino-5-chloro-7-(N-benzyl-trifluoromethylanilino)fluoran,
3-pyrrolidino-7-(di-p-chlorophenyl)methylaminofluoran,
3-diethylamino-5-chloro-7-(α-phenylethylamino)fluoran,
3-(N-ethyl-p-toluidino)-7-(α-phenylethylamino)fluoran,
3-diethylamino-7-(o-methoxycarbonylphenylamino)-fluoran,
3-diethylamino-5-methyl-7-(α-phenylethylamino)fluoran,
3-diethylamino-7-piperidinofluoran,
2-chloro-3-(N-methyltoluidino)-7-(p-n-butylanilino)-fluoran,
3-(N-benzyl-N-cyclohexylamino)-5,6-benzo-7- -naphthylamino-4'-bromofluoran,
3-diethylamino-6-methyl-7-mesidino-4',5'-benzofluoran, 3,6-dimethoxyfluoran,
3-(p-dimethylaminophenyl)-3-phenylphthalide,
3-di(1-ethyl-2-methylindole)-3-yl-phthalide,
3-diethylamino-6-phenyl-7-aza-fluoran,
3,3-bis(p-diethylaminophenyl)-6-dimethylaminophthalide,
2-bis(p-dimethylaminophenyl)methyl-5-dimethylaminobenzoic acid,
3-(p-dimethylaminophenyl)-3-(p-dibenzylaminophenyl) phthalide,
3-(N-ethyl-N-n-amyl)amino-6-methyl-7-anilinofluoran,
3-diethylamino-6-methyl-7-anilinofluoran,
3-(N-ethyl-N-isoamylamino)-6-methyl-7-anilinofluoran,
3-(N-methyl-N-n-hexylamino)-6-methyl-7-anilinofluoran,
3-(N-methyl-N-cyclohexylamino)-6-methyl-7-anilino-fluoran,
3-di-n-butylamino-6-ethyl-7-anilinofluoran, and
3-diethylamino-6-ethyl-7-(4'-methylanilino)fluoran.

Of the above leuco dyes, the fluoran compounds that can be represented by the following general formula are preferable for use in the present invention:

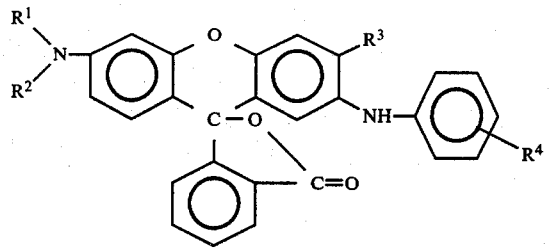

wherein $R^1$ and $R^2$ independently represent an alkyl group or cyclohexyl group having 1 to 8 carbon atoms, $R^3$ represents a methyl group or an ethyl group, and $R^4$ represents hydrogen or a methyl group.

Specific examples of the above fluoran compounds are as follows:
3-diethylamino-6-methyl-7-anilinofluoran,
3-(N-ethyl-N-isoamylamino)-6-methyl-7-anilinofluoran,
3-(N-methyl-N-n-hexylamino)-6-methyl-7-anilinofluoran,
3-(N-methyl-N-cyclohexylamino)-6-methyl-7-anilino-fluoran,
3-di-n-butylamino-6-ethyl-7-anilinofluoran, and
3-diethylamino-6-ethyl-7-(4'-methylanilino)fluoran.

As the color developers that can be used in combination with the zinc thiocyanate antipyrine complex in the present invention, a variety of electron acceptors can be employed, for instance, phenolic materials, organic and inorganic acids, salts and esters of the acids, which react with the above leuco dyes when heat is applied thereto to induce color formation in the leuco dyes.

Specific examples of the above color developers are as follows: gallic acid, salicylic acid, 3-isopropylsalicylic acid, 3-cyclohexylsalicylic acid, 3,5-di-tert-butylsalicylic acid, 3,5-di-α-methylbenzylsalicylic acid, 4,4'-isoproylidenediphenol, 4,4'-isopropylidenebis(2-chlorophenol), 4,4'-isopropylidenebis(2,6-dibromophenol), 4,4'-isopropylidenebis(2,6-dichlorophenol), 4,4'-ispropylidenebis(2-methylphenol), 4,4'-isopropylidenebis(2,6-dimethylphenol), 4,4'-isopropylidenebis(2-tert-butylphenol), 4,4'-sec-butylidenediphenol, 4,4'-cyclohexylidenebisphenol, 4,4'cyclohexylidenebis(2-methylphenol), 4-tert-butylphenol, 4-phenylphenol, 4-hydroxy-diphenoxide, α-naphthol, β-naphthol, 3,5-xylenol, thymol, methyl 4-hydroxybenzoate, 4-hydroxyacetophenone, novolak-type phenolic resin, 2,2'-thiobis(4,6-dichlorophenol), catechol, resorcinol, hydroquinone, pyrogallol, phloroglucine, phloroglucinocarboxylic acid, 4-tert-octylcatechol, 2,2'-methylenebis(4-chlorophenol), 2,2'-methlenebis(4-methyl-6-tert-butylphenol), 2,2'-dihydroxydiphenyl, ethyl p-hydroxybenzoate, propyl p-hydroxybenzoate, butyl p-hydroxybenzoate, benzyl p-hydroxy-benzoate, p-chlorobenzyl p-hydroxybenzoate, o-chlorobenzyl p-hydroxybenzoate, p-methylbenzyl p-hydroxybenzoate, n-octyl p-hydroxybenzoate, benzoic acid, zinc salicylate, 1-hydroxy2-naphthoic acid, 2-hydroxy-6-naphthoic acid, zinc 2-hydroxy-6-naphthoate, 4-hydroxy diphenyl sulfone, 4-hydroxy-4'-chlorodiphenyl sulfone, bis(4-hydroxyphenyl)sulfide, 2-hydroxy-p-toluic acid, zinc 3,5-di-tert-butylsalicylate, tin 3,5-di-tert-butylsalicylate, tartalic acid, oxalic acid, maleic acid, citric acid, succinic acid, stearicacid, 4-hydroxy phthalic acid, boric acid, thiourea derivatives and 4-hydroxythiophenol derivatives.

In the present invention, a variety of conventional binder agents can be employed for binding the above mentioned leuco dyes and color developers in the thermosensitive coloring layer to the support member.

Specific examples of such binder agents are as follows: polyvinyl alcohol; starch and starch derivatives; cellulose derivatives such as methoxycellulose, hydroxyethylcellulose, carboxymethylcellulose, methylcellulose and ethylcellulose; water-soluble polymeric materials such as sodium polyacrylate, polyvinylpyrrolidone, acrylamide/acrylic acid ester copolymer, acrylamide/acrylic acid ester/methacrylic acid copolymer, styrene/maleic anhydride copolymer alkali salt, isobutylene/maleic anhydride copolymer alkali salt, polyacrylamide, sodium alginate, gelatin and casein; and polyvinyl acetate, polyurethane, styrene/butadiene copolymer, polyacrylic acid, polyacrylic acid ester, vinyl chloride/vinyl acetate copolymer, polybutylmethacrylate, ethylene/vinyl acetate copolymer and styrene/butadiene/acrylic acid derivative copolymer.

Further in the present invention, auxiliary additive components which are employed in the conventional thermosensitive recording materials, such as fillers, surface active agents and thermo-fusible materials (or unguents), can be employed.

As the fillers, for example, the following can be employed: inorganic powders of calcium carbonate, silica, zinc oxide, titanium oxide, aluminum hydroxide, zinc hydroxide, barium sulfate, clay, talc and surface-treated calcium and silica; and organic powders of urea formaldehyde resin, styrene/methacrylic acid copolymer and polystyrene resin.

As the thermo-fusible materials, for example, higher fatty acids, esters, amides and metallic salts thereof, waxes, condensation products of aromatic carboxylic acids and amines, benzoic acid phenyl esters, higher straight chain glycols, 3,4-epoxy-dialkyl hexahydrophthalate, higher ketones and other thermo-fusible organic compounds having melting points ranging from about 50° C. to 200° C. can be employed.

The thermosensitive recording material according to the present invention can be prepared, for example, by successively applying an undercoat layer formation liquid, a thermosensitive coloring layer formation liquid and a protective layer formation liquid to an appropriate support member such as paper, synthetic paper or plastic film, and drying the applied liquids. The thus prepared thermosensitive recording material can be employed for recording in a wide variety of fields.

By referring to the following examples, the present invention will now be explained in detail.

EXAMPLE 1

[Preparation of Thermosensitive Coloring Layer Formation Liquid]

A dispersion A-1, a dispersion B-1 and a dispersion C-1 were separately prepared by grinding and dispersing the following respective components in a sand grinder for 3 hours:

| Dispersion A-1 | Parts by Weight |
|---|---|
| 3-N—methyl-3-N—cyclohexylamino-6-methyl-7-anilinofluoran | 200 |
| 10% aqueous solution of polyvinyl alcohol | 200 |
| Water | 600 |

| Dispersion B-1 | Parts by Weight |
|---|---|
| Zinc thiocyanate antipyrine complex | 150 |
| Calcium carbonate | 100 |
| 10% aqueous solution of polyvinyl alcohol | 200 |
| Water | 550 |

| Dispersion C-1 | Parts by Weight |
|---|---|
| N—stearylbenzamide | 200 |
| 5% aqueous solution of methylcellulose | 400 |
| Water | 400 |

Dispersion A-1, dispersion B-1 and dispersion C-1 were mixed in a ratio by weight of 1:5:3, so that a thermosensitive coloring layer formation liquid was prepared.

Preparation of Proctective Layer Formation Liquid

A dispersion D-1 and a dispersion E-1 were separately prepared by grinding and dispersing the following respective components in a sand grinder for 3 hours:

| Dispersion D-1 | Parts by Weight |
|---|---|
| Silica | 40 |
| 10% aqueous solution of polyvinyl alcohol (Kuraray PVA-117) | 500 |
| Zinc stearate | 60 |
| Water | 400 |

| Dispersion E-1 | Parts by Weight |
|---|---|
| 30% aqueous solution of polyamide resin | 100 |
| 10% aqueous solution of polyvinyl alcohol (Kuraray PVA-117) | 500 |
| Water | 400 |

Dispersion D-1 and dispersion E-1 were mixed in a ratio by weight of 1:1, so that a protective layer formation liquid was prepared.

The first prepared thermosensitive coloring layer formation liquid was applied to the surface of a sheet of commercially available high quality paper (52 g/m$^2$) by a wire bar and was then dried, with a deposition of 5.5 g/m$^2$ when dried, whereby a thermosensitive coloring layer was formed on the high quality paper.

Thereafter, the protective layer formation liquid was applied to the thermosensitive coloring layer with a deposition of 4.0 g/m$^2$ when dried by a wire bar, so that a protective layer was formed on the thermosensitive coloring layer. Thus, a thermosensitive recording material was prepared. This was then subjected to calendering, so that surface of the thermosensitive coloring layer was made smooth to a degree of 1000 sec in terms of Bekk's smoothness, whereby a thermosensitive recording material No. 1 according to the present invention was prepared.

EXAMPLE 2

Example 1 was repeated except that the dispersion E-1 employed in Example 1 was replaced by a dispersion E-2 with the following formulation, whereby a thermosensitive recording material No. 2 according to the present invention was prepared.

| Dispersion E-2 | Parts by Weight |
|---|---|
| 10% aqueous solution of polyvinyl alcohol (Kuraray PVA-117) | 500 |
| Water | 500 |

In the above dispersion E-2, 100 parts by weight of the 30% aqueous solution of polyamide resin in the dispersion E-1 employed in Example 1 was replaced by 100 parts by weight of water.

EXAMPLE 3

Example 1 was repeated except that the dispersion E-1 employed in Example 1 was replaced by a dispersion E-3 with the following formulation, whereby a thermosensitive recording material No. 3 according to the present invention was prepared.

| Dispersion E-3 | Parts by Weight |
|---|---|
| 30% aqueous solution of polyamide resin | 100 |
| 40% aqueous emulsion of polyacrylic acid ester | 125 |
| Water | 775 |

In the above dispersion E-3, 500 parts by weight of the 10% aqueous solution of polyvinyl alcohol in the dispersion E-1 employed in Example 1 was replaced by 125 parts by weight of a 40% aqueous emulsion of polyacrylic acid ester and 375 parts by weight of water.

EXAMPLE 4

An undercoat layer formation liquid was prepared by grinding and dispersing the following components in a sand grinder for 3 hours:

| | Parts by Weight |
|---|---|
| 25% aqueous dispersion of organic filler (urea - formaldehyde resin) | 400 |
| 40% styrene - butadiene copolymer emulsion | 100 |
| Water | 500 |

The above undercoat layer formation liquid was applied to the surface of a sheet of commercially available high quality paper (52 g/m$^2$) by a wire bar and was then dried, with a deposition of 2 g/m$^2$ when dried, so that an undercoat layer was formed on the high quality paper.

Thereafter, a thermosensitive coloring layer and a protective layer were successively formed on the undercoat layer in the same manner as in Example 1, followed by the same calendering as in Example 1, whereby a thermosensitive recording material No. 4 according to the present invention was prepared.

EXAMPLE 5

Example 1 was repeated except that the dispersion A-1 employed in Example 1 was replaced by a dispersion A-2 with the following formulation, whereby a thermosensitive recording material No. 5 according to the present invention was prepared.

| Dispersion A-2 | Parts by Weight |
|---|---|
| 3-N—methyl-3-N—cyclohexylamino-6-methyl-7-anilinofluoran | 100 |
| 3-N,N—dibutylamino-7-(o-chloro-anilino)fluoran | 100 |
| 10% aqueous solution of polyvinyl alcohol | 200 |
| Water | 600 |

In the above dispersion A-2, 100 parts of 3-N-methyl-3-N-cyclohexylamino-6-methyl-7-anilinofluoran in the dispersion A-1 employed in Example 1 were replaced by 100 parts of 3-N,N-dibutylamino-7-(o-chloroanilino)fluoran.

EXAMPLE 6

Example 1 was repeated except that the dispersion C-1 employed in Example 1 was replaced by a dispersion C-2 with the following formulation, whereby a thermosensitive recording material No. 6 according to the present invention was prepared.

| Dispersion C-2 | Parts by Weight |
|---|---|
| Stearamide | 200 |
| 5% aqueous solution of methylcellulose | 400 |
| Water | 400 |

In the above dispersion C-2, 200 parts by weight of N-stearylbenzamide in the dispersion C-1 employed in Example 1 were replaced by 200 parts by weight of stearamide.

EXAMPLE 7

Example 1 was repeated except that the dispersion D-1 employed in Example 1 was replaced by a dispersion D-2 with the following formulation, whereby a thermosensitive recording material No. 7 according to the present invention was prepared.

| Dispersion D-2 | Parts by Weight |
|---|---|
| Calcium carbonate | 40 |
| 10% aqueous solution of polyvinyl alcohol (Kuraray PVA-117) | 500 |
| Zinc stearate | 60 |
| Water | 400 |

In the above dispersion D-2, 40 parts by weight of silica in the dispersion D-1 employed in Example 1 were replaced by 40 parts by weight of calcium carbonate.

COMPARATIVE EXAMPLE 1

Example 1 was repeated except that the protective layer formed in Example 1 was eliminated, whereby a comparative thermosensitive recording material No. 1 was prepared.

COMPARATIVE EXAMPLE 2

Example 4 was repeated except that the protective layer formed in Example 4 was eleminated, whereby a comparative thermosensitive recording material No. 2 was prepared.

COMPARATIVE EXAMPLE 3

Example 1 was repeated except that the dispersion B-1 employed in Example 1 was replaced by the following comparative dispersion CB-1, whereby a comparative thermosensitive recording material No. 3 was prepared.

| Comparative Dispersion CB-1 | Parts by Weight |
|---|---|
| Bisphenol A | 150 |
| Calcium carbonate | 100 |
| 10% aqueous solution of polyvinyl alcohol | 200 |
| Water | 550 |

In the above comparative dispersion CB-1, 150 parts by weight of zinc thiocyanate antipyrine complex employed in the dispersion B-1 in Example 1 were replaced by 150 parts by weight of Bisphenol A.

COMPARATIVE EXAMPLE 4

Example 1 was repeated except that the dispersion D-1 and dispersion E-1 employed in Example 1 were respectively replaced by the following comparative dispersion CD-1 and CE-1, whereby a comparative thermosensitive recording material No. 4 was prepared.

| Comparative Dispersion CD-1 | Parts by Weight |
|---|---|
| Silica | 40 |
| 40% aqueous emulsion of polyacrylic acid ester emulsion | 125 |
| Zinc stearate | 60 |
| Water | 775 |

| Comparative Dispersion CE-1 | |
|---|---|
| 30% aqueous solution of polyamide resin | 100 |
| 40% aqueous emulsion of polyacrylic acid ester emulsion | 125 |
| Water | 775 |

In the comparative dispersions CD-1 and CE-1, 500 parts of the 10% aqueous solution of polyvinyl alcohol employed in the dispersion D-1 and the dispersion E-1 were each replaced by 125 parts of 40% polyacrylic acid methyl ester emulsion and 375 parts by weight of water.

The thermosensitive recording materials No. 1 through No. 7 according to the present invention and the comparative thermal recording materials No. 1 through No. 4 were subjected to the following tests to check the image density, oil resistance and plasticizer resistance of the images developed in the thermosensitive recording materials and alcohol resistance of the background of the thermosensitive recording materials.

(1) Image Density

Each thermosensitive recording material was subjected to a thermal printing test by use of a heat gradient test apparatus (made by Toyo Seiki Co., Ltd.) at 100° C. with a pressure of 2 kg/cm$^2$, with a heat application time of 1 second, so that printed images were formed on each thermosensitive recording material. The image densities of the printed images were measured by a Macbeth densitometer RD-514 with a built-in filter W-106.

(2) Oil Resistance of Developed Images

To the developed images on the thermosensitive recording materials, there was applied cotton seed oil, and the recording materials were then allowed to stand at 40° C., 90%RH for 24 hours to see whether or not the images were discolored or caused to disappear by the oil.

(3) Plasticizer Resistance of Developed Images

Samples of the above thermosensitive recording materials with a size of about 4 cm$^2$ were made so as to include image areas in the central portion thereof and were laid on a polyvinyl chloride wrapping film with a load of 500g/cm$^2$ applied at room temperature for 24 hours and for 72 hours. Thereafter, the densities of the image areas of those samples were measured by the above-mentioned Macbeth densitometer RD-514, so that the image densities of the samples before and after the above polyvinyl chloride film test were compared.

(4) Alcohol Resistance of the Backgrounds of the Recording Materials

After the thermal printing in (4), 100% ethanol was applied to each thermosensitive recording material and was then immediately wiped off the recording material by absorbent cotton, so that the density of the background was measured by the Macbeth densitometer.

The results of the above tests are shown in the following table.

TABLE 1

| | | Image Density | Oil Resistance | Plasticizer Resistance 24 hr | Plasticizer Resistance 72 hr | Alcohol Resistance |
|---|---|---|---|---|---|---|
| Example | 1 | 1.21 | 1.21 | 1.18 | 1.12 | 0.09 |
| | 2 | 1.23 | 1.22 | 1.19 | 1.10 | 0.09 |
| | 3 | 1.25 | 1.26 | 1.17 | 1.08 | 0.10 |
| | 4 | 1.31 | 1.30 | 1.28 | 1.22 | 0.09 |
| | 5 | 1.20 | 1.18 | 1.15 | 1.01 | 0.08 |
| | 6 | 1.22 | 1.21 | 1.20 | 1.15 | 0.09 |
| | 7 | 1.25 | 1.25 | 1.24 | 1.18 | 0.09 |
| Comparative Example | 1 | 1.33 | 1.31 | 1.03 | 0.65 | 0.32 |
| | 2 | 1.36 | 1.37 | 1.11 | 0.72 | 0.35 |
| | 3 | 1.23 | 0.42 | 0.36 | 0.24 | 0.26 |
| | 4 | 1.23 | 1.22 | 1.10 | 0.82 | 0.26 |

The above results indicate that the thermosensitive recording materials according to the present invention are capable of yielding images which are exceedingly more resistant to the oil, plasticizer and alcohol as compared with the comparative thermosensitive recording materials.

What is claimed is:

1. A thermosensitive recording material comprising a support member, a thermosensitive coloring layer formed on said support material, comprising a binder agent, a colorless or light-colored leuco dye, a zinc thiocyanate antipyrine complex having the following formula, which serves as a color developer capable of inducing color formation in said leuco dye upon application of heat thereto, and a protective layer consisting essentially of a water-soluble resin for protecting the thermosensitive coloring layer:

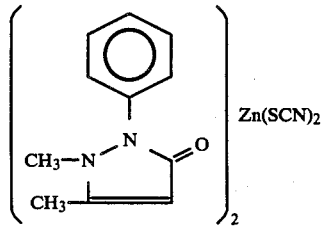

2. A thermosensitive recording material as claimed in claim 1, wherein said protective layer further comprises a water-insoluble resin in combination with said water-soluble resin.

3. A thermosensitive recording material as claimed in claim 2, wherein said water-insoluble resin is selected from the group consisting of polyvinyl acetate, polyurethane, styrene/butadiene copolymer, polyacrylic acid, polyacrylic acid ester, vinyl chloride/vinyl acetate copolymer, polybutylmethacrylate, ethylene/vinyl acetate copolymer and styrene/butadiene/acrylic derivative copolymer.

4. A thermosensitive recording material as claimed in claim 1, wherein said protective layer further comprises a water-resisting agent in an amount of 0.1 part by weight to 2..0 parts by weight to one part by weight of said water-soluble resin.

5. A thermosensitive recording material as claimed in claim 4, wherein said water-resisting agent is selected from the group consisting of polyamide resin, melamine resin, formaldehyde, glyoxal and chromium alum.

6. A thermosensitive recording material as claimed in claim 1, wherein said protective layer further comprises a filler selected from the group consisting of calcium carbonate, silica, zinc oxide, titanium oxide, aluminum hydroxide, zinc hydroxide, barium sulfate, clay, talc, surface-treated calcium and surface-treated silica, urea formaldehyde resin, styrene/methacrylic acid copolymer and polystyrene.

7. A thermosensitive recording material as claimed in claim 1, further comprising an undercoat layer consisting essentially of a filler and a binder agent interposed between said support member and said thermosensitive coloring layer.

8. A thermosensitive recording material as claimed in claim 7, wherein said binder agent contained in said undercoat layer is selected from the group consisting of polyvinyl alcohol, starch, starch derivatives, methoxycellulose, hydroxyethylcellulose, carboxymethylcellulose, methylcellulose, ethylcellulose, sodium polyacrylate, polyvinyl pyrrolidone, polyacrylamide/acrylic acid ester copolymer acrylamide/acrylic acid ester/methacrylic acid copolymer, styrene/maleic anhydride copolymer alkali salt, isobutylene/maleic anhydride copolymer alkali salt, polyacrylamide, sodium alginate, gelatin, casein, carboxyl-group-modified polyvinyl alcohol and water-soluble polyester, polyvinyl acetate, polyurethane, styrene/butadiene copolymer, polyacrylic acid, polyacrylic acid ester, vinyl chloride/vinyl acetate copolymer, polybutylmethacrylate, ethylene/vinylacetate copolymer and styrene/butadiene acrylic derivative copolymer.

9. A thermosensitive recording material as claimed in claim 7, wherein said filler contained in said undercoat layer is selected from the group consisting of calcium carbonate, silica, zinc oxide, titanium oxide, aluminum hydroxide, zinc hydroxide, barium sulfate, clay, talc, surface-treated calcium and surface-treated silica, urea formaldehyde resin, styrene/methacrylic acid copolymer and polystyrene.

10. A thermosensitive recording material as claimed in claim 1, wherein said leuco dye is selected from the group consisting of triphenylmethane-type leuco compounds, fluoran-type leuco compounds, phenothiazine-type leuco compounds, auramine-type leuco compounds and spiropyran-type leuco compounds.

11. A thermosensitive recording material as claimed in claim 1, wherein said leuco dye is selected from the group consisting of the fluoran compounds having the following general formula:

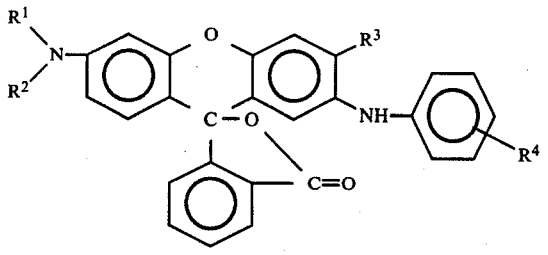

wherein $R^1$ and $R^2$ independently represent an alkyl group or cyclohexyl group having 1 to 8 carbon atoms, $R^3$ represents a methyl group or an ethyl group, and $R^4$ represents hydrogen or a methyl group.

12. A thermosensitive recording material as claimed in claim 1, wherein said water-soluble resin employed in said protective layer is selected from the group consisting of polyvinyl alcohol, starch, starch derivatives, cellulose derivatives such as methoxycellulose, hydroxyethylcellulose, carboxymethylcellulose, methylcellulose and ethylcellulose, sodium polyacrylate, polyvinyl pyrrolidone, polyacrylamide/acrylic acid ester copolymer, acrylamide/acrylic acid ester/methacrylic acid copolymer, styrene/maleic anhydride copolymer alkali salt, isobutylene/maleic anhydride copolymer alkali salt, polyacrylamide, sodium alginate, gelatin, casein, water-soluble polyester and carboxyl-group-modified polyvinyl alcohol.

13. A thermosensitive recording material as claimed in claim 1, further comprising a color developer in combination with said zinc thiocyanate antipyrine complex, selected from the group consisting of gallic acid, salicylic acid, 3-isopropylsalicylic acid, 3-cyclohexylsalicylic acid, 3,5-di-tert-butylsalicylic acid, 3,5-di-α-methylbenzylsalicylic acid, 4,4'-isoproylidenediphenol, 4,4'-isopropylidenebis(2-chlorophenol), 4,4'-isopropylidenebis(2,6-dibromophenol), 4,4'-isopropylidenebis(2,6-dichlorophenol), 4,4'-ispropylidenebis(2-methylphenol), 4,4'-isopropylidenebis(2,6-dimethylphenol), 4,4'-isopropylidenebis(2-tert-butylphenol), 4,4'-sec-butylidenediphenol, 4,4'-cyclohexylidenebisphenol, 4,4'-cyclohexylidenebis(2-methylphenol), 4-tert-butylphenol, 4-phenylphenol, 4-hydroxy-diphenoxide, α-naphthol, β-naphthol, 3,5-xylenol, thymol, methyl 4-hydroxybenzoate, 4-hydroxyacetophenone, novolak-type phenolic resin, 2,2'-thiobis(4,6dichlorophenol), catechol, resorcinol, hydroquinone, pyrogallol, phloroglucine, phloroglucinocarboxylic acid, 4-tert-octylcatechol, 2,2'-methylenebis(4-chlorophenol), 2,2'-methlenebis(4-methyl-6-tert-butylphenol), 2,2'-dihydroxydiphenyl, ethyl p-hydroxybenzoate, propyl p-hydroxybenzoate, butyl p-hydroxybenzoate, benzyl p-hydroxybenzoate, p-chlorobenzyl p-hydroxybenzoate, o-chlorobenzyl p-hydroxybenzoate, p-methylbenzyl p-hydroxybenzoate, n-octyl p-hydroxybenzoate, benzoic acid, zinc salicylate, 1-hydroxy-2-naphthoic acid, 2-hydroxy-6-naphthoic acid, zinc 2-hydroxy-6-naphthoate, 4-hydroxy diphenyl sulfone, 4-hydroxy-4'-chlorodiphenyl sulfone, bis(4-hydroxyphenyl)-sulfide, 2-hydroxy-p-toluic acid, zinc 3,5-di-tert-butyl-salicylate, tin 3,5-di-tert-butylsalicylate, tartalic acid, oxalic acid, maleic acid, citric acid, succinic acid, stearic acid, 4-hydroxy phthalic acid, boric acid, thiourea derivatives, and 4-hydroxythiophenol derivatives.

14. A thermosensitive recording material as claimed in claim 1, wherein said thermosensitive coloring layer further comprises an auxiliary additive selected from the group consisting of a filler, a surface active agent and a thermofusible material.

* * * * *